United States Patent [19]

Fortier, Jr. et al.

[11] Patent Number: 4,820,219

[45] Date of Patent: Apr. 11, 1989

[54] RECREATIONAL DEVICE

[76] Inventors: Thomas H. Fortier, Jr., 2404 W. San Miguel, Phoenix, Ariz. 85015; Carl J. Buetzow, 5915 West Holly, Phoenix, Ariz. 85035

[21] Appl. No.: 679,482

[22] Filed: Dec. 7, 1984

[51] Int. Cl.[4] ..... A63C 15/00

[52] U.S. Cl. ..... 441/66; 152/511; 272/1 B; 273/58 BA; 427/256; 427/393.5; 428/12; 428/36; 441/67; 446/224

[58] Field of Search ..... 152/349, 350, 374, 359 R, 152/195, 510–512, 450, 453; 156/116, 118, 121; 428/35, 36, 12, 494, 517; 446/220, 224; 525/333.9; 425/45, 49, 51, 52; 273/58, 58 BA, 65 E, 65 EA; 427/256, 393.5; 272/1 B; 441/40, 66, 67, 131, 41

[56] References Cited

U.S. PATENT DOCUMENTS

| | | | |
|---|---|---|---|
| 2,761,155 | 9/1956 | Headley | 441/40 |
| 3,021,536 | 2/1962 | Haggerty | 441/40 |
| 3,135,978 | 6/1964 | Grasmoen | 441/66 |
| 3,623,900 | 11/1971 | Jonnes et al. | 156/116 X |
| 4,366,963 | 1/1983 | Reeves et al. | 441/40 |
| 4,461,795 | 7/1984 | Ogawa | 156/116 X |

OTHER PUBLICATIONS

Renfrew et al, Polyethylene, The Technology and Uses of Ethylene Polymers, 2nd Edition, Interscience Publishers, Inc., New York, NY, pp. 397–402; TP 986, p. 56 R4 1960 C.3.

*Primary Examiner*—Michael W. Ball
*Assistant Examiner*—Thomas Bokan
*Attorney, Agent, or Firm*—Richard R. Mybeck

[57] ABSTRACT

A recreational device comprising an elastomeric body portion capable of holding compressed gas and having a surface temperature reducing coating integrally formed therewith on the outer surface thereof. The device is used in water sports where flotation is desired to reduce creature discomfort and physiological damage.

10 Claims, 1 Drawing Sheet

RECREATIONAL DEVICE

INTRODUCTION

The present invention relates to a recreational device and more particularly to a floating device for use when engaged in water sports to enhance the maximum enjoyment while minimizing the solar hazards associated therewith.

BACKGROUND

Popular contemporary recreational activities involving water include such individual or group endeavors as swimming, fishing, boating, or "tubing" (that sport which involves entering a river upstream and riding the current downstream sitting on or laying across a tire inner tube as a floation device). Inner tubes are also useful in swimming and fishing when a floating platform is desired.

In most climes, the described water activities usually occur in bright sunlight on warm summer days and frequently result in heat discomfort. Further, when costumes are brief, the user risks possible blistering of body parts from the accumulation of rays and heat directly from the sun or reflected from the surface of the water. It can be readily understood that the minimal clothing often used while participating in water sports or "tubing" could exacerbate discomfort and/or physiological damage.

SUMMARY OF INVENTION

The present invention comprises a device which provides greater user comfort while providing conventional flotation. More particular, the device comrises a hydrophobic waterproof elastomeric body capable of holding compressed gas for floatation purposes having a special corrosion resistant heat reflective surface integrally formed on or with the upper portion thereof.

The present invention is in part predicated upon the discovery that a unique interaction is obtained between conventional inner tube materials and a coating material containing a chlorosulfonated polyethylene dissolved/-suspended in dimethylbenzene. With chlorosulfonated, polyethylene containing 20–45% chlorine and 1–2.5% sulfur, the action creates a long wearing, corrosion resistant, heat dissipating surface capable of providing the needed creature comforts hereinbefore described.

Accordingly, a prime object of the present invention is to provide a new and improved recreational device capable of resisting the deleterious effects of adverse environmental factors while providing protection for the occupant from the searing effects of solar heat and radiation.

Another object of the present invention is to provide a new and improved recreational device which is especially suited to enhance the enjoyment while minimizing the discomfort associated with the sport of tubing and the like.

A still further object of the present invention is to provide a recreational device especially useful in water sports which is easily manufactured, handy to transport, ready to assemble and requires no special training to enable the operator to enjoy the full benefit thereof.

Still another object of the present invention is to provide compositions and methods of producing an improved recreational floatation device which provides a pleasureful experience for the user while reducing the user's fatigue and heat discomfort.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DRAWINGS

DESCRIPTION OF EXEMPLARY EMBODIMENTS

Figure 1:
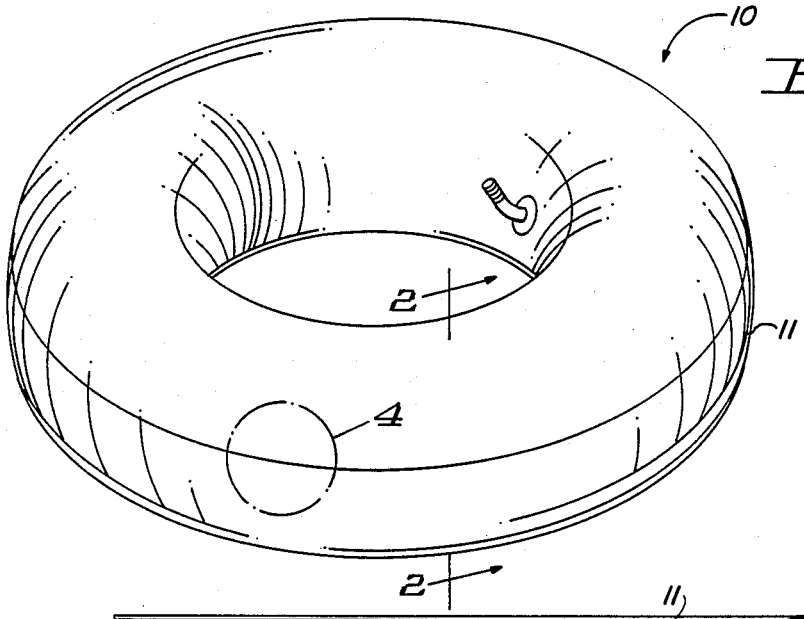
FIG. 1 is an isometric showing of a device embodying the present invention.
Figure 4:
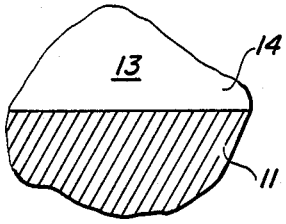
FIG. 4 is an enlarged fragment of area 4 as marked on FIG. 1.
Figure 2:
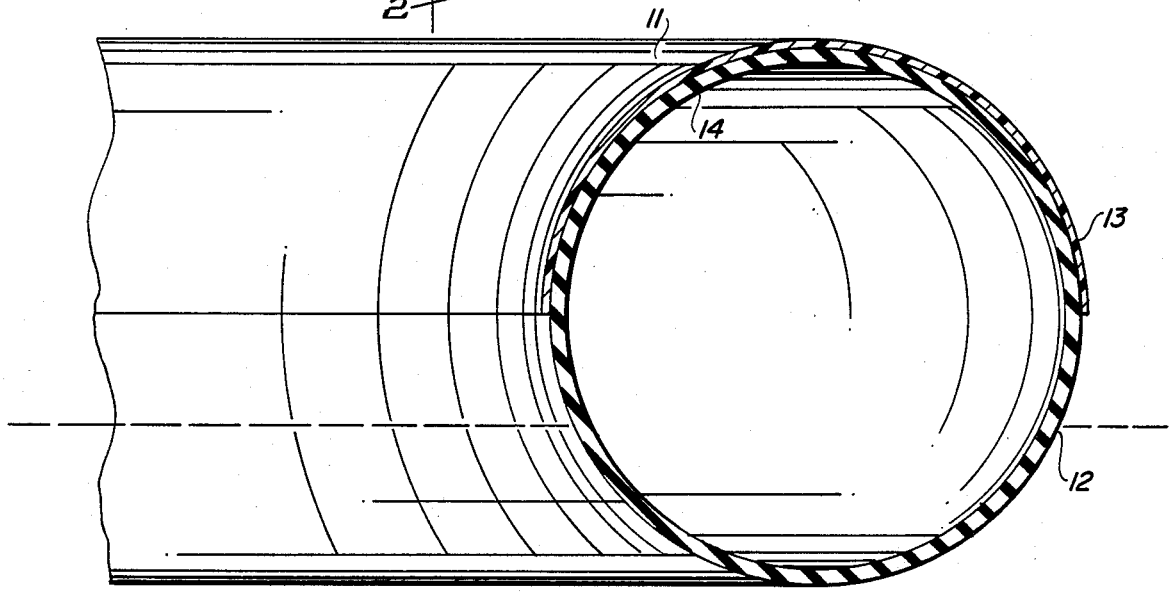
FIG. 2 is a partially broken cross section taken on line 2—2 of FIG. 1.
Figure 5:
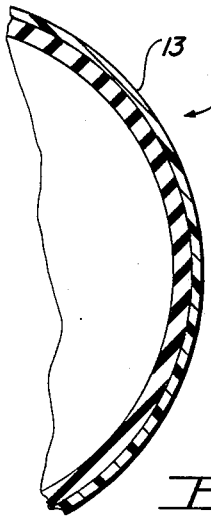
FIG. 5 is an enlarged fragment of an alternative embodiment of the present invention.
Figure 3:
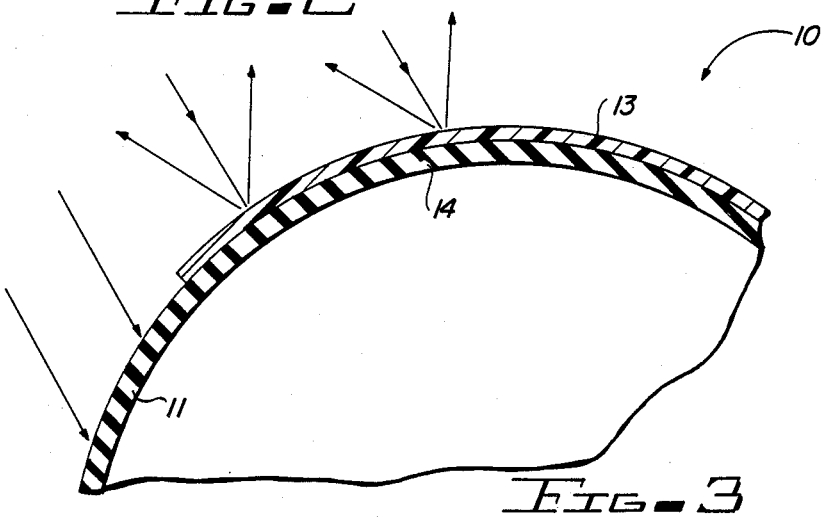
FIG. 3 is a fragmented cross section of the device shown in FIG. 1.

Referring to FIG. 1, a device 10 embodying the present invention comprises a rubber-like or latex or neoprene or other elastomeric body capable of containing compressed gas such as inner tube 11 upon the outer surface 12 of which has been integrally formed a white film surface 13 on the uppermost half 14 of tube 11. Surface 13 can be formed as shown in FIGS. 2, 3 and 4, or, it can be applied over the entire exterior surface of tube 11 as shown in FIG. 5. In usual use, approximately the lower half of the body 11 will be submerged into the water so that for pragmatic reasons the coating on the top surface thereof is all that is essential to provide the benefits of this invention for most applications. The full coating however does eliminate the need to orient the device 10 at the time it is placed into the water.

An alternative embodiment of the invention comprises an enlarged body 11 capable of providing a floatation platform for stationary or multiple person use. This embodiment still comprises an elastomeric enclosure 11 capable of holding compressed gas therewithin.

In the preferred practice of the present invention, a chlorosulfonated polyethylene elastomer (commercially available under the trade name HYPALON® from DuPont) is dissolved and/or suspended in dimethylbenzene. This material is then applied to the upper surface of the elastomeric floatation device or tube using coventional coating techniques such as spraying, brushing and the like. The coated device is then allowed to cure at room temperature. When cured, the resulting film integrally adheres to and coacts with the material of the floatation device to provide a heat-reflective, corrosion-resistant substantive film throughout the coated portion of the base unit.

While the application of coatings to elastomeric substances has heretofore resulted in unsightly and ineffectual surfaces which readily cracked or peeled within a very short period of time, especially when those surfaces were subjected to the hostile environment found in use, e.g., domestic swimming pools treated with chlorine and algacide compounds to control algae and bacteria, a device embodying the present invention has been subjected to the swimming pool environment for more than three weeks without any noticable change in the appearance or substantiuity of the applied film.

In additional testing, devices embodying the present invention were exposed to direct sunlight in a pool. One device was positioned with its coated side exposed to the sun and another device was positioned with its black (uncoated) side exposed to the sun. After one hour, the exposed dark side of the one tube had a surface temperature of 156° F. while the coated side on the other tube had a surface temperature of 123° F. This unexpected large differential in surface temperature (33° ) and the ability of the coated side to maintain temperatures below 140° F. clearly demonstrates the utility of the device in preventing pain, skin damage or burns when used as a floatation platform in water sports.

As used herein "chlorosulfonated polyethylene" describes polyethylene chlorinated in the presence of sulfur dioxide which permits various amounts of sulfonyl chloride groups to be introduced into the polymer structure. The addition of a polybasic metal oxide or a polybasic metal salt of a weak acid, an organic acid, and an organic accelerator provide the basis for effective curing. The principal crosslinking reaction is believed to occur between the metal oxide and sulfonic acid. Normally the reaction will be conducted in an anhydrous solvent such as carbon tetrachloride. Suitable catalyzers include organic peroxides or azobisisobutyronitrile.

In a preferred practice, the polymer will be placed in solution and the reaction carried out at a temperature sufficient to dissolve the polyethylene polymer in the solvent. Superatmospheric pressure may be employed to achieve the desired result. The reaction will be allowed to proceed until the chlorine content of the polymer reaches the range of 20–45% and the sulfur content of the polymer is in the range of 1–2.5%.

Uncured chlorosulfonated polyethylene is readily soluble in aromatic and chlorinated hydrocarbons and soluble to some extent in ketones, esters, alicyclic hydrocarbons, alcohols and glycols.

Optimum properties are realized with chlorosulfonated polyethylene containing 30–35% (by weight) chlorine and 0.8–1.5% (by weight) sulfonyl sulfur. Magnesia or titanium dioxide or other whiting materials provide suitable pigmentation to the coating surface.

In general, chlorosulfonated polyethylenes may be processed using ordinary procedures on standard processing equipment and they may be mixed satisfactorily in internal mixers or on open mills.

To further aid in the understanding of the present invention and not by way of limitation, the following examples are presented.

EXAMPLE 1

A coating formulation is prepared by admixing 90 parts of chlorosulfonated polyethylene with 3 parts of hydrogenated rosin and 135 parts toluene. This mixture is transferred to a pebble mill where 40 parts of tribasic lead maleate, 1.5 parts of 2-mercaptobenzothiazyl disulfide, 0.5 parts of tetramethylthiuram disulfide, 2 parts of isophthalic acid, 70 parts of titanium dioxide, 120 parts of toluene, 10 parts of mineral spirits and 20 parts of butyl alcohol are added and mixed to obtain fineness. Thereafter, 10 parts of chlorosulfonated polyethylene and 40 parts of toluene are introduced and the milling is continued until the polymer solution is effected.

EXAMPLE 2

An inner tube of conventional manufacture is coated with a composition prepared according to Example 1. After curing, the device was inspected and found to have an integral resilient coating formed thereupon which resisted bending and reflected solar heat.

From the foregoing, it is apparent that a device has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

What is claimed is:

1. A floatable recreational device for use in water sport comprising an elastomeric annular tube capable of expanding when filled with gaseous fluid without disrupting a long-wearing, corrosion resistant, heat dissipating coating integrally formed therewith on the outer surface thereof, said coating comprising an elastomer containing chlorosulfonated polyethylene as its principal ingredient.

2. A device according to claim 1 which, when placed in a body of water defines a water line therewith which circumscribes said annular tube to divide said tube into an upper portion and a lower portion relative to said water line, said coating being formed on at least said upper portion.

3. A device according to claim 2 in which said coating is formed upon and adheres to said upper portion and said lower portion.

4. A device according to claim 2 in which said tube coating is formed of a cured elastomer containing chlorosulfonated polyethylene as its principal ingredient which is dissolved in dimethylbenzene for application thereto.

5. A device according to claim 3 in which said coating is formed of a cured elastomer containing chlorosulfonated polyethylene as its principal ingredient which is dissolved in dimethylbenzene for application thereto.

6. A device according to claim 1 in which said annular tube is formed of natural or synthetic rubber.

7. A device according to claim 2 in which said annular tube is formed of natural or synthetic rubber.

8. A device according to claim 3 in which said annular tube is formed of natural or synthetic rubber.

9. A device according to claim 2 in which said coating is formed from pigmented chlorosulfonated polyethylene.

10. A device according to claim 3 in which said coating is formed from pigmented chlorosulfonated polyethylene.

* * * * *